US005638979A

United States Patent [19]

Shea

[11] Patent Number: 5,638,979

[45] **Date of Patent: *Jun. 17, 1997**

[54] THERMAL REFLECTIVE PACKAGING SYSTEM

[75] Inventor: David B. Shea, Richmond, Va.

[73] Assignee: Radiant Technologies, Inc., Richmond, Va.

[ * ] Notice: The term of this patent shall not extend beyond the expiration date of Pat. No. 5,314,087.

[21] Appl. No.: 248,020

[22] Filed: May 24, 1994

Related U.S. Application Data

[63] Continuation-in-part of Ser. No. 66,840, May 26, 1993, Pat. No. 5,314,087.

[51] Int. Cl.[6] ..... B65D 5/56

[52] U.S. Cl. ..... 220/450; 206/521; 220/412

[58] Field of Search ..... 220/450, 521, 220/412, 460, 409; 206/521; 383/110

[56] References Cited

U.S. PATENT DOCUMENTS

| | | | |
|---|---|---|---|
| 2,053,803 | 9/1936 | Schweller | 220/9 |
| 2,695,744 | 11/1954 | Gattuso | 229/14 |
| 3,341,051 | 9/1967 | Forman et al. | 220/9 |
| 3,472,568 | 10/1969 | Southwick | 312/31 |
| 3,885,730 | 5/1975 | Christensson | 229/43 |
| 4,185,673 | 1/1980 | Daniello | 383/110 |
| 4,537,313 | 8/1985 | Workman | 383/110 |
| 4,889,252 | 12/1989 | Rockhom et al. | 220/3.1 |
| 5,111,957 | 5/1992 | Hollander et al. | 220/408 |

*Primary Examiner*—Joseph M. Moy

*Attorney, Agent, or Firm*—Millen, White, Zelano, & Branigan, P.C.

[57] ABSTRACT

A shipping or transport container system comprises an inner liner for insertion into an inner shipping container, for further insertion into an outer shipping container. The inner liner comprises a layer of single- or double-bubble radiant barrier material within a sealed vinyl pouch. Between the outer container and the inner container there is furnished at least one spacer insert, which may be a spacer tray or the like, for providing a partially-surrounding pocket of air in contact with the exterior surface of the inner container. During sealing of the pouch, a pocket of air is allowed to remain in its interior so that the radiant barrier material floats within the sealed pouch. The pockets of air provided allow for maximization of the thermal insulating properties of the system due primarily to the thermal reflective property of the radiant barrier material. The vinyl construction of the pouch material provides a durable protective cover for the radiant barrier material.

6 Claims, 7 Drawing Sheets

THERMAL REFLECTIVE PACKAGING SYSTEM

BACKGROUND OF THE INVENTION

This is a continuation-in-part of U.S. patent application Ser. No. 08/066,840, filed May 26, 1993 now U.S. Pat. No. 5,314,087 the entire disclosure of which is incorporated herein by reference.

1. Field of the Invention

The invention relates to thermally-insulated packaging, and more particularly to a packaging system with improved insulating characteristics for transporting perishables and the like.

2. Related Art

The shipment or transport of perishable materials frequently requires that such materials remain at a stable temperature which is either elevated or decreased with respect to ambient temperatures to which the packaging is exposed. Because of long transport times and/or sensitivity of certain contents to even slight temperature fluctuations, efforts have been made to provide shipping containers with improved insulating characteristics.

U.S. Pat. No. 4,889,252 to Rockom et al. suggests bonding of bubble-type insulation to an inner surface of a corrugated paperboard box to provide insulation and shock-absorbency. However, because of the direct contact of the bubble-type insulation with the paperboard, much of the potential thermal containment abilities of bubble-type insulation are subject to being undermined by the conduction of temperatures via the bubble-type insulation to or from the paperboard box and subsequently to or from the ambient atmosphere. The device according to Rockom et al. does not permit reuse of the insulating liner in other shipping containers when a first shipping container becomes worn. Further, the paperboard box of Rockom et al. is not fully collapsible once the insulation is bonded thereto.

Where extended shipping times and/or contents with extraordinary sensitivity to temperature fluctuations are involved, shipping containers with adequate insulating characteristics have not been provided by the prior art. Where contents requiring decreased temperatures are involved, it is often necessary to include a refrigerant, such as dry ice or gel packs, within the shipping container to maintain low temperatures, especially for extended periods of time. However, dry ice is expensive and considered hazardous by shipping handlers because of burning effects which are caused by its contact with the skin. Both dry ice and gel packs are relatively bulky, and their use therefore requires the use of a shipping container substantially larger than its primary contents. And, both means add substantially to the weight of the shipping container. Further, dry ice produces Carbon Dioxide gas, which is harmful if inhaled in high concentrations. For all of these reasons, national shipping companies, food service providers, caterers, pharmaceutical shippers, and others often charge an increased rate for shipping or transport of contents requiring temperature maintenance during transport.

SUMMARY OF THE INVENTION

It is therefore an object of the invention to provide a shipping or transport container system with improved insulating and thermal containment characteristics.

It is a further object of the invention to provide a device which can be retrofitted to an existing transport container to improve the insulating characteristics thereof.

It is a further object of the invention to provide a shipping or transport container system which can be used at a lower cost than those of the prior art.

It is a further object of the invention to provide a shipping or transport container system which is safer in use than those of the prior art.

In a preferred embodiment, the invention provides a shipping or transport container system which comprises an inner liner for insertion into an inner shipping container, which may be further inserted into an outer shipping container or containers. The inner liner preferably comprises a layer of "single- or double-bubble" radiant barrier material within a sealed vinyl pouch. Between the outer container and the inner container, there is furnished at least one spacer insert, which may be in the form of corner-piece spacers, a spacer tray, or the like, for providing a partially-surrounding pocket of air in contact with the exterior surface of the inner liner. Preferably, sealing of the pouch is accomplished by a dielectric heat process. During sealing of the pouch, a pocket of air is permitted to remain in the pouch's interior so that the radiant barrier material "floats" within the sealed pouch. The pockets of air allow for maximization of the thermal containment properties of the system due primarily to the thermal reflective characteristics of the radiant barrier material itself. The vinyl construction of the pocket material provides a durable protective cover for the radiant barrier material, vinyl being resistant to both puncture and moisture. The inner and outer shipping containers are preferably of corrugated cardboard construction, but may alternatively comprise plastic, wood, or other similar construction. The inner liner is removable from the inner shipping container, thereby allowing disposal of the container and reuse of the liner in other containers, or for permitting breakdown and storage of the inner shipping container, etc.

In a second embodiment, the invention provides an improved insulating cover for encasing a transport container, such as a catering cart, or for covering goods resting on a pallet or the like. In this embodiment, the invention comprises a series of thermal panels which may be assembled to form a generally box-shaped cover for placing over the item to be insulated. Fastening of the panels together is preferably accomplished via a hook-and-loop fastening system, such as Velcro™ strips, attached along their edges. Each panel comprises a layer of "single- or double-bubble" radiant barrier material loosely encased within a stitched pouch of nylon or vinyl material in a manner whereby a pocket of air remains within the pouch. The invention according to the second embodiment provides an inexpensive means for thermally insulating a shipment of goods which are temperature-critical.

BRIEF DESCRIPTION OF THE DRAWINGS

The foregoing and other objects, features, and advantages of the invention will be apparent from the following more particular description of preferred embodiments as illustrated in the accompanying drawings in which reference characters refer to the same parts throughout the various views. The drawings are not necessarily to scale, emphasis instead being placed upon illustrating the principles of the invention.

DETAILED DESCRIPTION OF THE DRAWINGS

Figure 1:
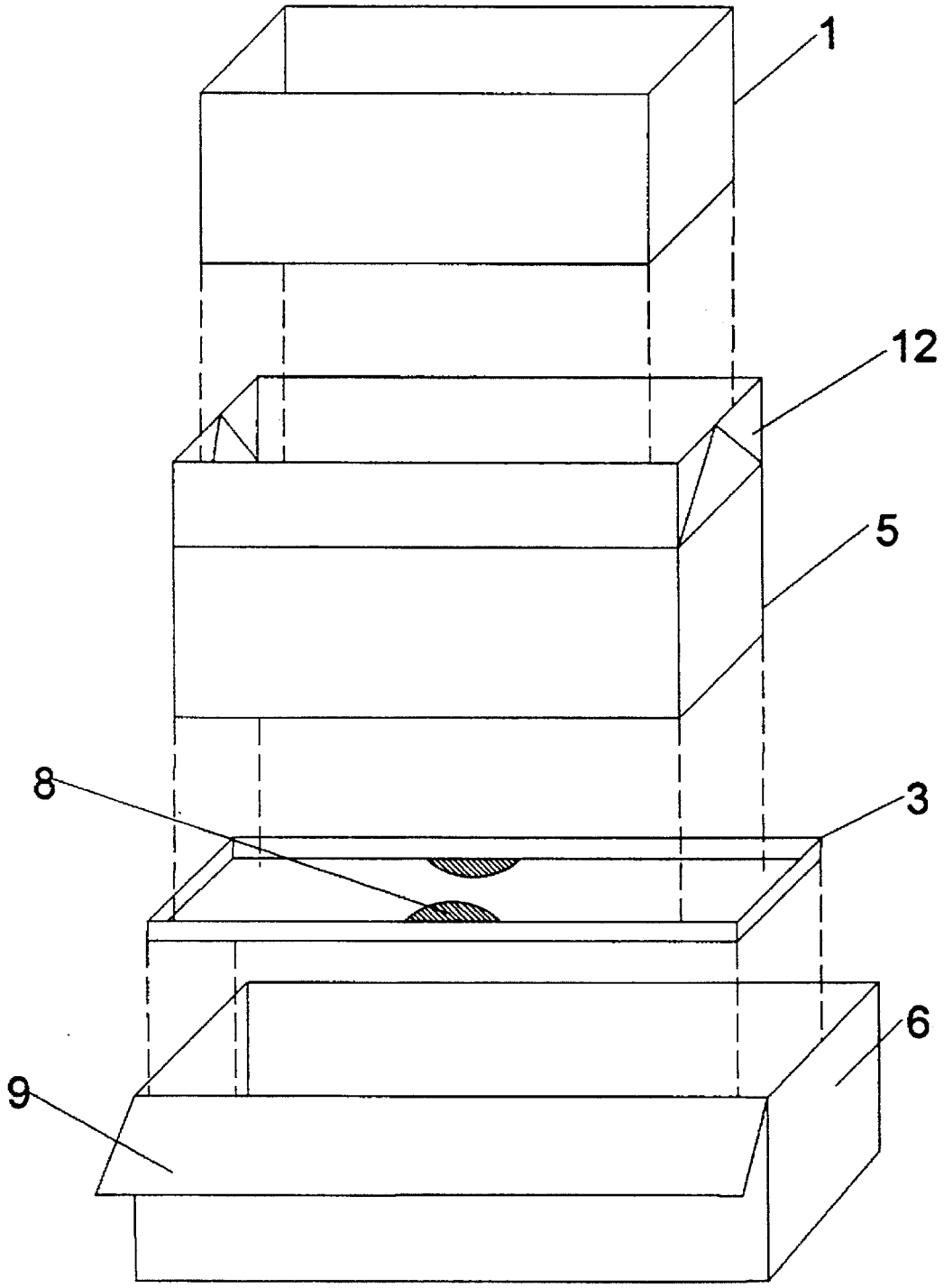
FIG. 1 is a schematic view illustrating the primary features of the invention according to a first embodiment.
Figure 2:
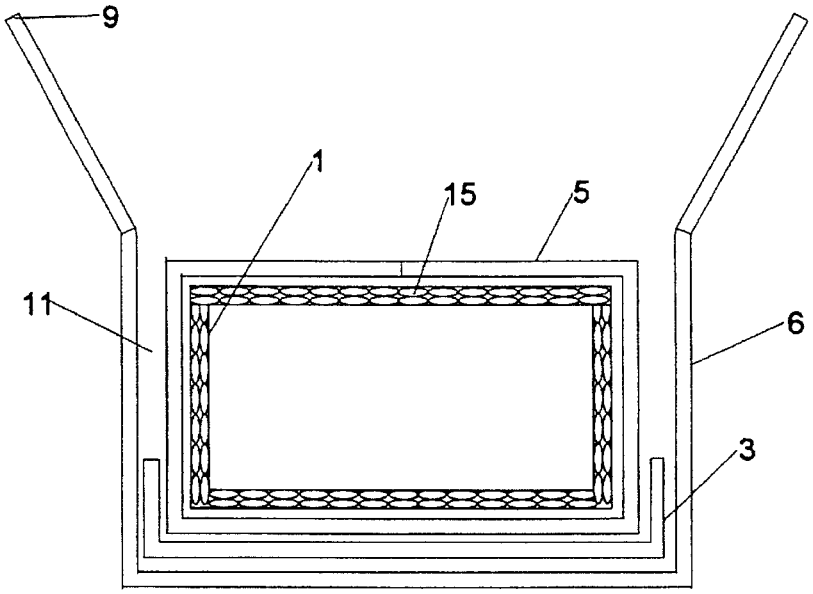
FIG. 2 is a cross-sectional view of the invention according to a first embodiment.

Referring to FIGS. 1 and 2, the invention provides a shipping or transport container system which comprises an inner liner 1 for insertion into an inner shipping container 5, for further insertion into an outer shipping container 6. Preferably, the inner shipping container 5 has a self-sealing type closure, as shown at 12. Between the outer container and the inner container there is furnished at least one spacer insert, which may be in the form of a spacer tray 3. Spacer tray 3 provides an air pocket 11 between Alternatively, a single corner-piece spacer insert can be provided at each of four bottom corners of said outer shipping container to provide an air space between the outer and inner shipping containers in a similar manner. When the outer shipping container is sealed, the spacer tray applies a distributed force over the self sealing closures of the inner container 5, thereby retaining the inner container in a sealed condition without need for sealing tape or the like. The spacer tray 3 may be provided with half-moon-shaped cutouts 8, for providing an extra air space in contact with the inner container. A flat lid 15, FIG. 2, rests upon and seals an open top area of inner liner 1. The outer shipping container 6 may be provided with a flap-type closure 9, as shown, or other conventional closure such as the self-sealing closure 12 shown with respect to the inner container 5.

Figure 2A:
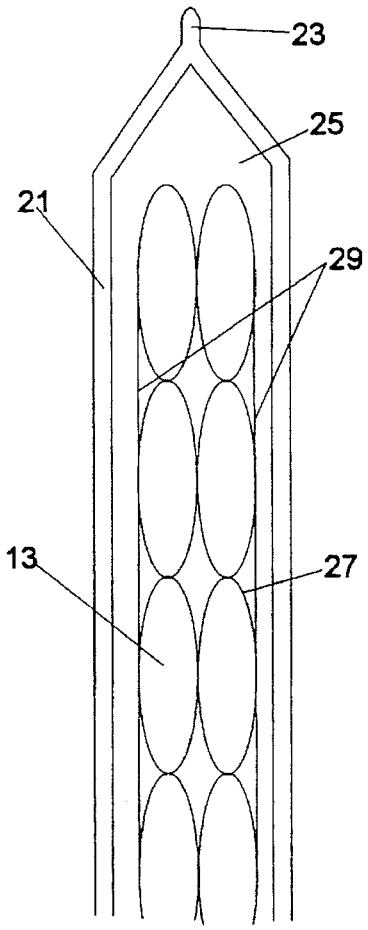
FIG. 2*a* is a cross section of the radiant pouch utilized in the invention according to a first embodiment.

Referring to FIG. 2*a*, the inner liner 1 preferably comprises a layer of single- or double-bubble radiant barrier material 13 within a sealed pouch 21 of vinyl material. The radiant barrier material 13 preferably comprises two layers of extruded polymer bubble packing material 27 having bonded to their exterior surfaces a thin layer of reflective material 29, such as aluminum sheet material. Alternatively, a thin layer of reflective sheet material may be used alone as the radiant barrier material without being bonded to single- or double-bubble material. Sealing of the pouch 21 is preferably accomplished via dielectric heat sealing of the end portions 23 of the vinyl material. During dielectric heat sealing, a pocket of air 25 is permitted to remain in the pouch's interior so that the radiant barrier material is held loosely within the sealed pouch, being surrounded by layers of air. The layers of air allow for maximization of the thermal insulating properties of the system due primarily to the thermal reflective property of the radiant barrier material. The vinyl construction of the pocket material provides a durable protective cover for the radiant barrier material, vinyl being resistant to both puncture and moisture.

A spacer tray 3 provides a partially-surrounding layer of air 11 in contact with the exterior surface of the inner container 5. This partially surrounding layer of air allows further maximization of the thermal containment properties of the radiant barrier material.

Figure 3:
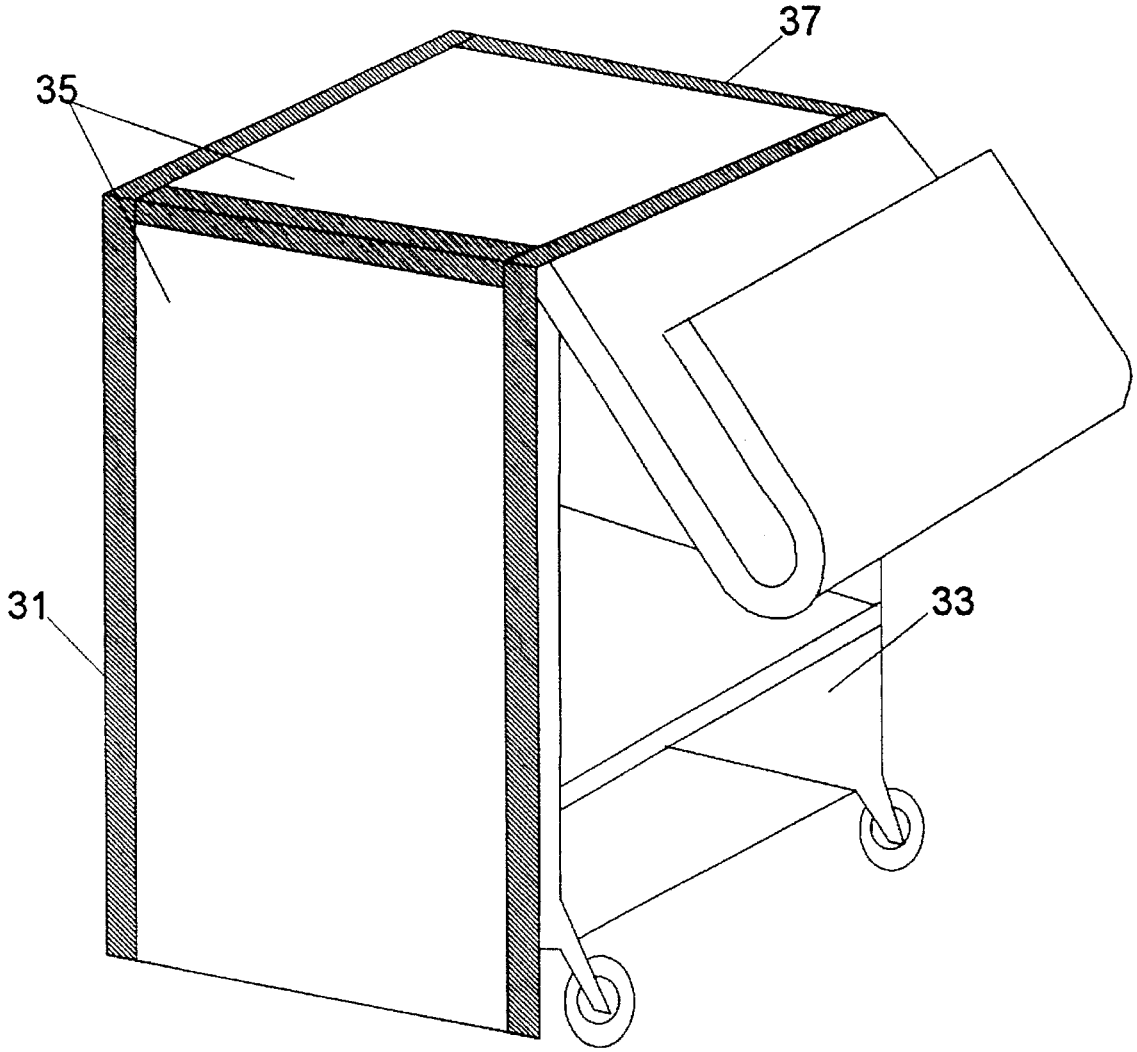
FIG. 3 illustrates the primary features of the invention according to a second embodiment.

FIG. 3 illustrates a second embodiment of the invention wherein there is provided an improved insulating cover 31 for encasing a transport container, such as a catering cart 33. It should be understood that the present embodiment may also be used to provide improved insulating cover for, e.g., covering goods resting on a pallet or the like. In the present embodiment, the invention comprises a series of thermal panels 35 which may be assembled to form a generally box-shaped cover for placing over the item(s) to be insulated. Fastening of the panels together is preferably accomplished via a hook-and-loop fastening system, such as Velcro™ strips 37, attached along their edges.

Figure 3A:
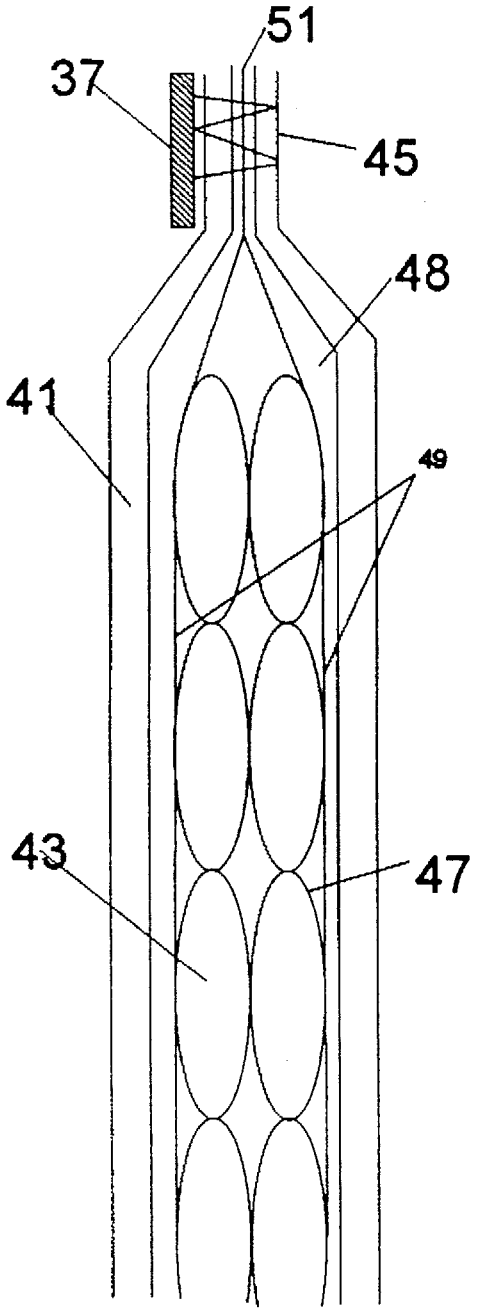
FIG. 3*a* is a cross-section of a thermal panel utilized in the invention according to a second embodiment.

Referring to FIG. 3*a*, each panel comprises a layer of single- or double-bubble radiant barrier material 43 loosely encased within a pouch of nylon material 41 which is stitched together at end portions 45 in a manner whereby a pocket of air 48 remains within the pouch. In this embodiment, an end portion 51 of the double-bubble radiant barrier material 43 is preferably sandwiched between, and stitched to, the nylon material 41 at end portion 45. The radiant barrier material 43 is preferably comprised of a layer of double-bubble material 47 having bonded to its outer surfaces a thin layer of reflective material 49. The invention according to the second embodiment provides an inexpensive means for thermally insulating a shipment of goods which are temperature-critical. A non-limiting example includes use of the invention for covering a pallet holding bananas where that pallet is to be shipped alongside dairy products. Dairy products are generally shipped in a refrigerated environment which would impart a "browning" or "burning" effect to bananas if they were exposed to such environment. Use of the invention in such a manner provides an inexpensive means for thermally containing a room-temperature environment surrounding a shipment of bananas while allowing transport of the shipment in an otherwise refrigerated environment.

Figure 4:
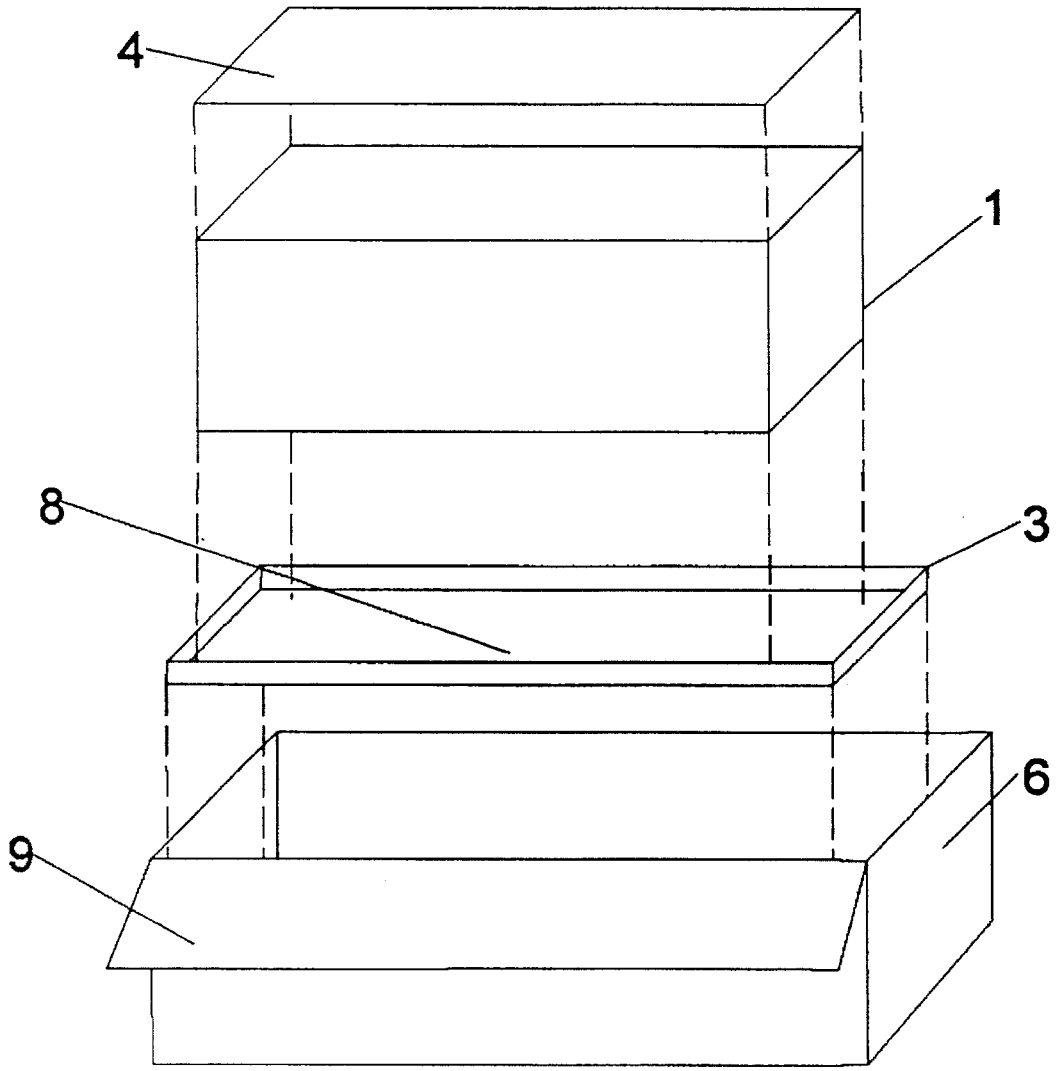
FIG. 4 is a schematic view of the invention according to a third embodiment.

FIG. 4 shows an alternative to the first embodiment illustrated in FIGS. 1–2*a*. According to this third embodiment, inner shipping container 5, FIG. 1, is not utilized. To compensate for a lack of support which said inner shipping container would otherwise impart to inner liner 5, the inner liner is constructed so as to have greater rigidity with respect to the inner liner of the first embodiment. Increased rigidity may be obtained, for example, by incorporating into the construction of the sealed pouch 21, FIG. 2*a*, a rigid material such as corrugated paperboard or the like. A lid 4, which may also be provided in the embodiment of FIG. 1, is of a construction similar to that of the inner liner 5.

Figure 5:
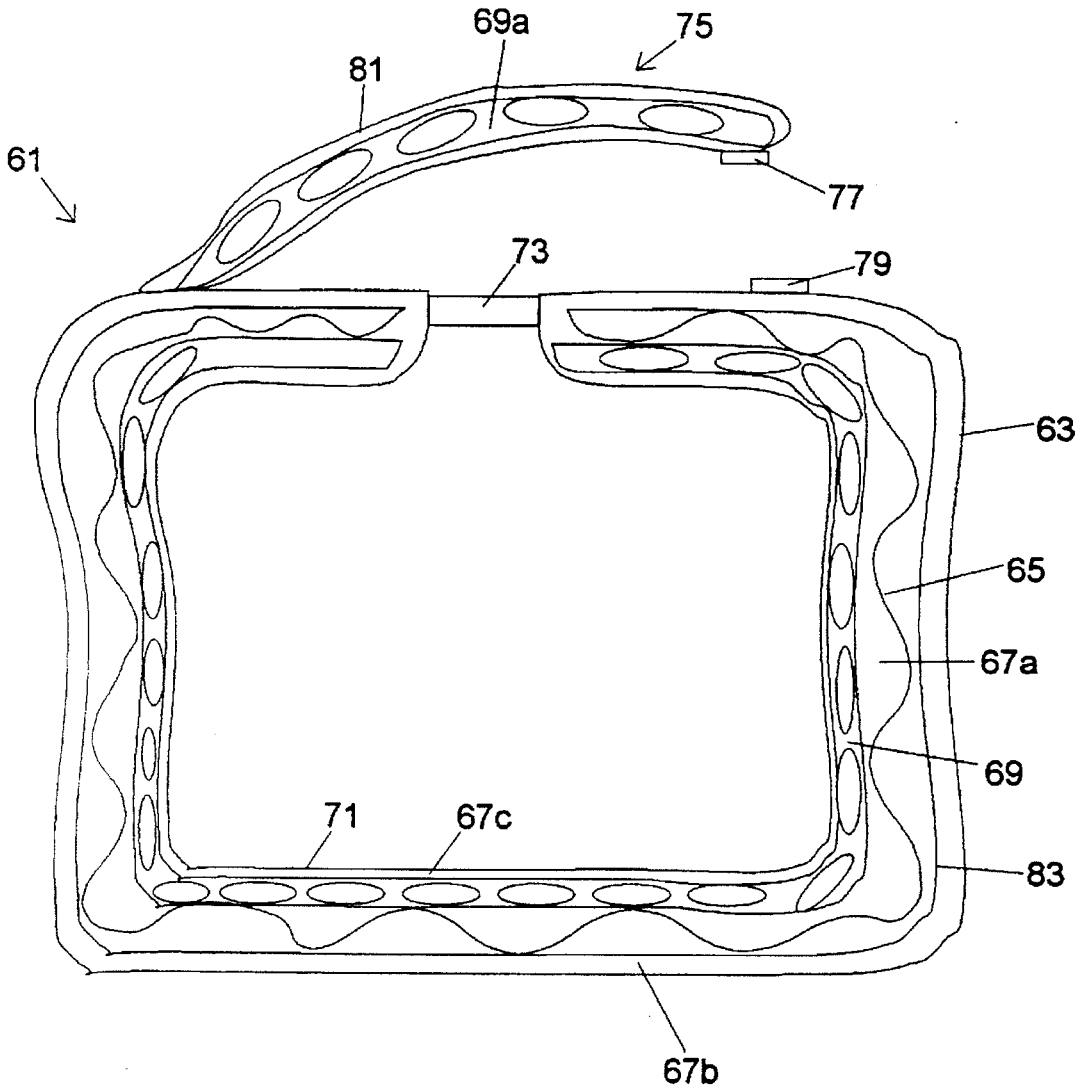
FIG. 5 is a cross-sectional end view of the invention according to a fourth embodiment.

FIG. 5 is a cross-sectional end view of the invention according to a fourth embodiment. According to this embodiment, a soft-sided transport container system is provided. This embodiment preferably takes the form of a thermal-resistant tote bag for transporting temperature-sensitive goods. The present embodiment operates according to the same principles as the first embodiment as discussed above, but comprises flexible components. The soft-sided transport container system 61 includes an outer protective shell material 63 which may be, e.g., nylon cordora or other protective material.

Air-pocket-creating means 65 provides a pocket or pockets of air 67*a* between the shell material 63 and a layer of radiant barrier material 69. Air-pocket-creating means 65 preferably comprises a layer of ¾ inch thick foam, but could comprise other means for creating pockets of air 67*a*, such as a series of baffles, etc. Radiant barrier material 69 preferably comprises a layer of single-bubble material having at least one facing side coated with a reflective layer of radiant material such as aluminum sheet material. However, the radiant barrier material 69 may comprise other radiant materials, such as a single sheet of reflective aluminum radiant material.

An inner lining 71 is preferably comprised of a vinyl or other rugged material. Increased thermal containment is provided by an additional layer of radiant material 83, which preferably comprises a single sheet of radiant barrier "claf." It should be recalled that a feature of the invention is that a layer or pocket of air is provided between a radiant barrier material and a thermal source (such as the contents of the transport container or the ambient atmosphere) to prevent conduction of thermal energy by the radiant barrier due to direct contact with the thermal source. Further pockets of air 67*b* and 67*c* are preferably provided in the present embodiment to ensure prevention of such conduction. Pockets 67*b* and 67*c* can be formed by sealing the outer shell material 63 to the inner lining 71 to create an airtight pouch therebetween.

A zipper 73 or similar fastening means is provided for closing the container's opening. A flap 75 is provided for thermally sealing the opening, particularly in the proximity of the zipper 73 which would not otherwise be thermally protected. The flap 75 preferably comprises a layer of single-bubble radiant barrier material 69*a* in a casing 81 of nylon cordora. Strips of hook-and-eye fastening material 77, 79 are sewn to the flap and the outer shell material 63, respectively, to provide a means for securing the flap in its closed position.

Figure 6:
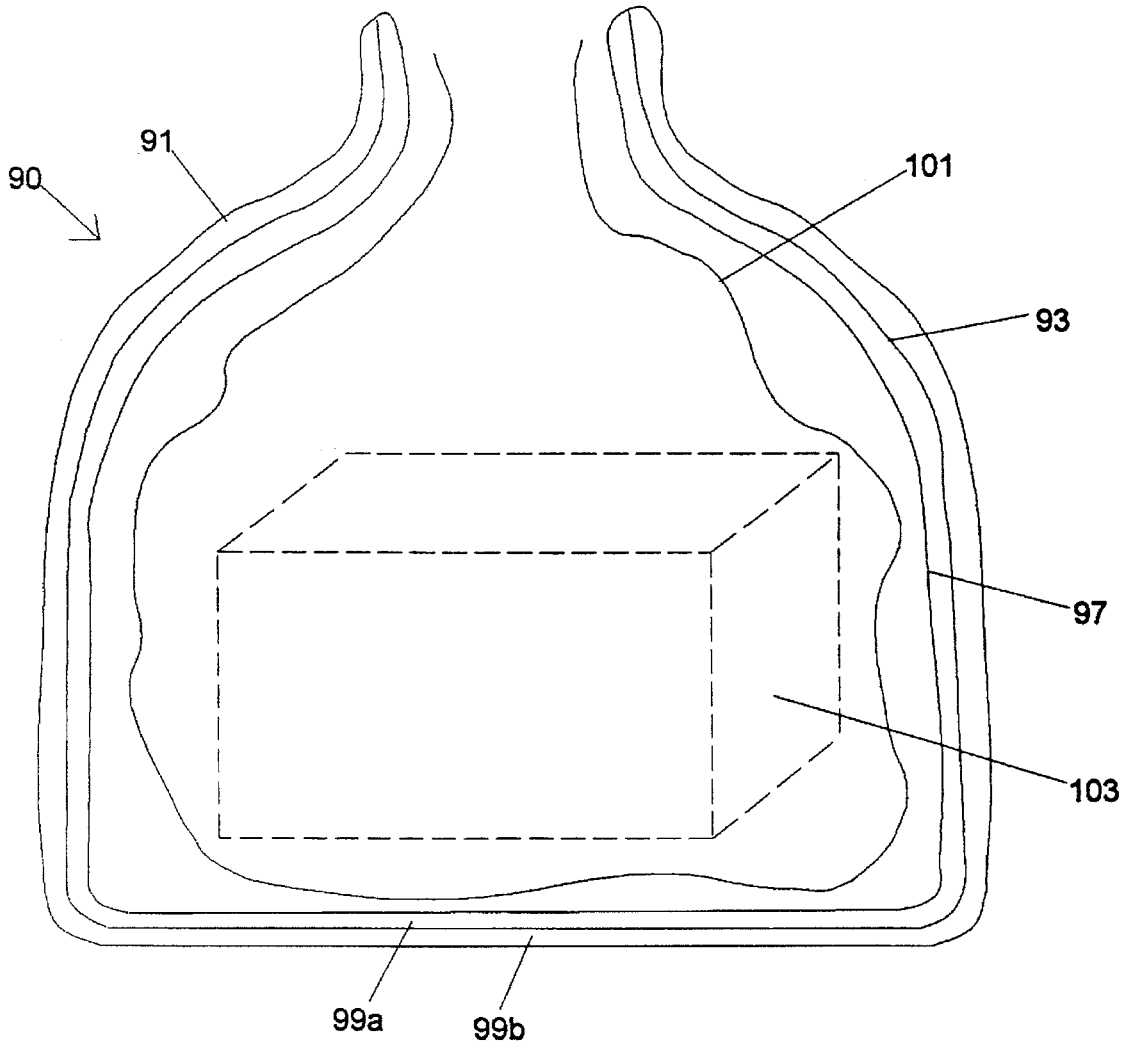
FIG. 6 is a cross-sectional view of the invention according to a fifth embodiment.

FIG. 6 is a cross-sectional view of the invention according to a fifth embodiment. Shown is a radiant bulk bag 90 for thermal containment of a shipment of goods 103 during tranport. An outer shell 91 preferably comprises an outer layer of polyethylene film bonded or otherwise attached to an inner layer of polyolefin or heavy-duty nylon. Radiant barrier material 93 preferably comprises a single layer of reflective radiant aluminum claf material. The radiant barrier material 93 is sealed between an inner shell 97, preferably comprising polyethylene film, and the outer shell 91 in a manner whereby pockets of air 99*a*, 99*b*, are in contact with its facing surfaces. An interior liner 101 of polyethylene may be provided for increased strength and durability.

While the invention has been particularly shown and described with reference to preferred embodiments thereof, it will be understood by those skilled in the art that various changes in form and details may be made therein without departing from the spirit and scope of the invention. For example, nylon can be substituted for vinyl in the inner liner construction. Or, the liner may be inserted into only one container. Further, a layer of thin reflective sheet material may be used alone as the radiant barrier material, without being bonded to single- or double-bubble material.

The embodiments of the invention in which an exclusive property or privilege is claimed are defined as follows:

1. A transport container system for thermal containment of thermally-sensitive goods during transport, comprising:

flexible inner liner means for forming a bag having an opening for insertion of said thermally-sensitive goods;

flexible outer shell means forming a bag operatively fastened to said flexible inner liner means by a fastening means in a manner whereby air space remains between said flexible outer shell means and said flexible inner liner means;

thermal reflective radiant barrier material provided in said air space, said radiant barrier material being substantially surrounded on at least one flat surface thereof by said air space, said thermal reflective radiant barrier material comprising at least one layer of extruded polymer type bubble material having two opposing outer plane surfaces, at least one of said opposing outer plane surfaces having reflective material bonded thereto; and, closure means for removably closing said opening.

2. The transport container system according to claim 1, further comprising:

biasing means for biasing said at least one flat surface away from one of said flexible inner liner or said flexible outer shell such that said at least one flat surface is prevented from substantial contact with adjacent surfaces, thereby reducing conduction of thermal energy by said radiant barrier material.

3. The transport container system according to claim 2, wherein said biasing means comprises foam sheet material inserted between said radiant barrier material and one of said flexible inner liner or said flexible outer shell.

4. The transport container system according to claim 1, further comprising:

second thermal reflective radiant barrier material between said radiant barrier material and one of said flexible inner liner or said flexible outer shell.

5. A transport container system for thermal containment of thermally-sensitive goods during transport, comprising:

flexible inner liner means for forming a bag having an opening for insertion of said thermally-sensitive goods;

flexible outer shell means forming a bag operatively fastened to said flexible inner liner means by a fastening means which comprises an airtight seal in a manner whereby air space remains between said flexible outer shell means and said flexible inner liner means;

thermal reflective radiant barrier material provided in said air space, said radiant barrier material being substantially surrounded on at least one flat surface thereof by said air space; and, closure means for removably closing said opening.

6. The transport container system according to claim 5, wherein said thermal reflective radiant barrier material comprises at least one layer of reflective radiant aluminum claf material.

* * * * *